US009669245B2

(12) United States Patent
Baron

(10) Patent No.: US 9,669,245 B2
(45) Date of Patent: Jun. 6, 2017

(54) SYSTEMS AND METHODS FOR REDUCING AN OVERPRESSURE CAUSED BY A VAPOR CLOUD EXPLOSION

(71) Applicant: EXXONMOBIL CHEMICAL PATENTS INC., Baytown, TX (US)

(72) Inventor: Norbert Baron, Cologne (DE)

(73) Assignee: ExxonMobil Research and Engineering Company, Annandale, NJ (US)

( * ) Notice: Subject to any disclaimer, the term of this patent is extended or adjusted under 35 U.S.C. 154(b) by 264 days.

(21) Appl. No.: 14/648,812

(22) PCT Filed: Apr. 9, 2013

(86) PCT No.: PCT/US2013/035786

§ 371 (c)(1),
(2) Date: Jun. 1, 2015

(87) PCT Pub. No.: WO2013/158412

PCT Pub. Date: Oct. 24, 2013

(65) Prior Publication Data

US 2015/0335925 A1 Nov. 26, 2015

Related U.S. Application Data

(60) Provisional application No. 61/635,942, filed on Apr. 20, 2012.

(51) Int. Cl.

| | |
|---|---|
| ***A62C 2/00*** | (2006.01) |
| ***A62C 3/02*** | (2006.01) |
| ***A62C 99/00*** | (2010.01) |
| ***A62C 3/06*** | (2006.01) |

(52) U.S. Cl.
CPC ..... *A62C 3/0285* (2013.01); *A62C 3/06* (2013.01); *A62C 99/00* (2013.01); *A62C 99/0054* (2013.01)

(58) Field of Classification Search
CPC ..... A62C 3/0285; A62C 3/06; A62C 99/00; A62C 99/0054
USPC ..... 169/43, 45, 54, 64, 69
See application file for complete search history.

(56) References Cited

U.S. PATENT DOCUMENTS

| | | | | |
|---|---|---|---|---|
| 4,634,369 A * | 1/1987 | McGill | F23G 5/50 431/202 |
| 5,096,679 A * | 3/1992 | Lake | B01D 53/34 169/69 |
| 5,145,651 A * | 9/1992 | Lake | B01D 53/34 422/168 |
| 2003/0000951 A1* | 1/2003 | Clark | B65D 90/28 169/26 |

* cited by examiner

*Primary Examiner* — Steven J Ganey
(74) *Attorney, Agent, or Firm* — Glenn T. Barrett

(57) ABSTRACT

Systems and methods for reducing an overpressure caused by an explosion of a vapor cloud are provided. In one or more embodiments, the system can include one or more sensors operable to detect the explosion of the vapor cloud. The system can also include one or more igniters operable to ignite the vapor cloud at locations throughout, after the explosion of the vapor cloud is detected, to provide a discrete combustion zone at each location. Each combustion zone can form a discrete pressure wave, thereby reducing the overpressure caused by the explosion of the vapor cloud.

17 Claims, 9 Drawing Sheets

SYSTEMS AND METHODS FOR REDUCING AN OVERPRESSURE CAUSED BY A VAPOR CLOUD EXPLOSION

CROSS-REFERENCE TO RELATED APPLICATIONS

This application is a National Stage (Sec. 371) filing of International Application No. PCT/2013/035786, filed on Apr. 9, 2013, which claims the benefit of U.S. Provisional Application No. 61/635,942, filed on Apr. 20, 2012, the entire contents of both of which are hereby incorporated by reference.

PRIORITY CLAIM

This application claims the benefit of and priority to U.S. Ser. No. 61/635,942, filed Apr. 20, 2012.

FIELD

Embodiments described herein generally relate to systems and methods for reducing an overpressure development caused by a vapor cloud explosion. More particularly, such embodiments relate to systems and methods for reducing an overpressure caused by a vapor cloud explosion by reducing a distance a given pressure wave front or flame front travels.

BACKGROUND

A potential danger with hydrocarbon and other chemical extraction or production, processing, refining, and/or storage facilities is that vapors, e.g., gaseous hydrocarbons or other combustible vapors, can escape into the atmosphere and form a vapor cloud. Being combustible, such vapor cloud can be unintentionally ignited causing an explosion or what is commonly referred to as a "vapor cloud explosion" or simply "VCE." During a vapor cloud explosion, a flame front forms and outwardly expands from the point of ignition. As the flame front expands, it can accelerate toward sonic velocity and cause the formation of an overpressure as it passes around structures in its way, such as piping, process equipment, and buildings. This overpressure can have a significant and detrimental effect on the structures, as well as the people in and around the site of the vapor cloud explosion. The overpressure can not only damage the structure(s) and severely injure humans; it can also cause the complete collapse of structures and death. Additionally, any structures located a few or even several kilometers away from a vapor cloud explosion can be damaged, e.g., broken windows, as a result of the overpressure.

To mitigate the dangers and damages posed by vapor cloud explosions, processing equipment, such as extraction, reaction, separation, refining, storage, and the like, have been monitored for leaks or potential leaks that could result in the formation of a combustible or flammable vapor cloud. If such a leak is detected, the process equipment is shut down to prevent and/or reduce the amount of gas released. Another step taken to reduce the damaging effects of vapor cloud explosions is to over-engineer structures, i.e., to construct buildings and other structures with additional reinforcement or stronger materials. Neither monitoring for leaks nor over-engineering structures, however, contributes to a reduction or prevention of an overpressure formed as the result of a vapor cloud explosion.

There is a need, therefore, for new systems and methods for reducing an overpressure caused by combustion of a vapor cloud.

SUMMARY OF THE INVENTION

Systems and methods for reducing an overpressure caused by an explosion of a vapor cloud are provided. In one or more embodiments, the system can include one or more sensors operable to detect the explosion of the vapor cloud. The system can also include one or more igniters operable to ignite the vapor cloud at multiple locations throughout, after the explosion of the vapor cloud is detected, to provide a discrete combustion zone at each location. Each combustion zone can form a discrete pressure wave, thereby reducing the overpressure caused by the explosion of the vapor cloud.

In one or more embodiments, the method for reducing an overpressure caused by an explosion of a vapor cloud in a facility can include detecting the explosion of the vapor cloud. After detecting the explosion of the vapor cloud, the vapor cloud can be ignited at multiple locations throughout to provide a discrete combustion zone at each location. Each combustion zone can form a discrete pressure wave, thereby reducing the overpressure caused by the explosion of the vapor cloud.

DETAILED DESCRIPTION

Figure 1:
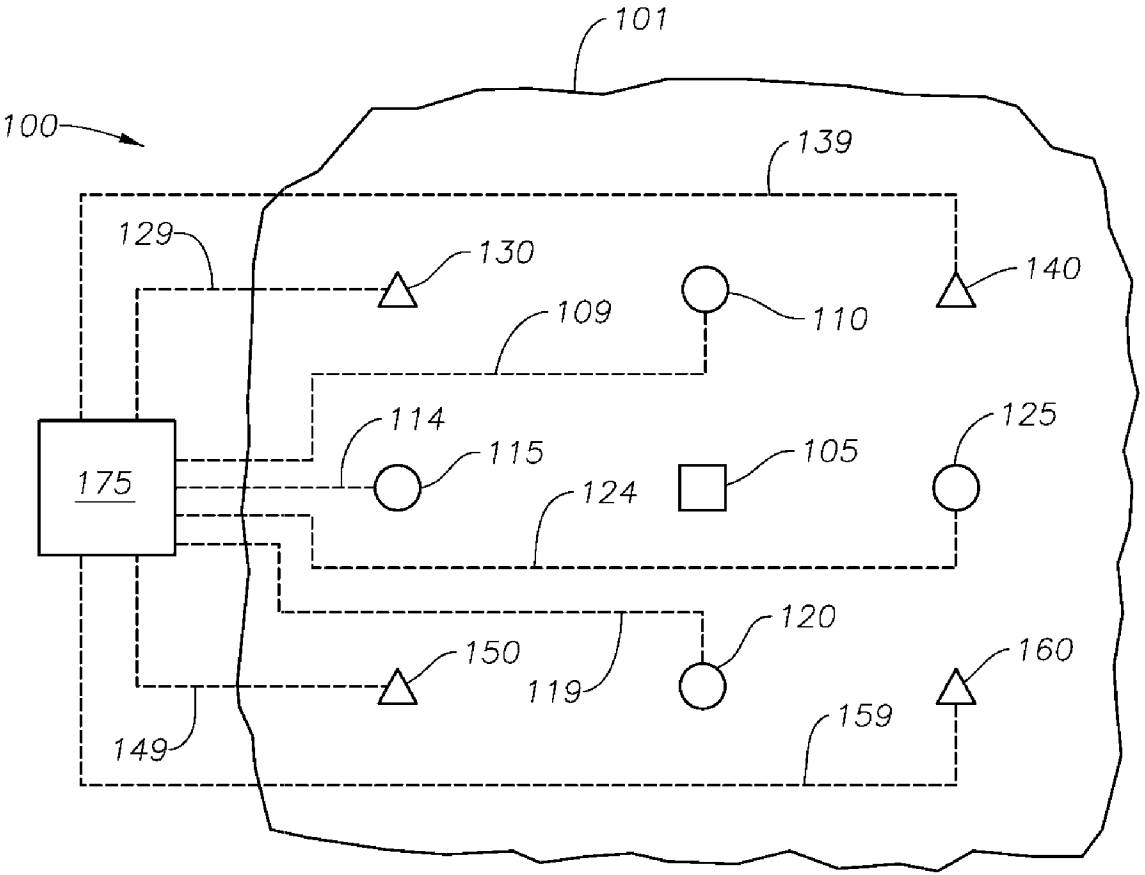
FIG. 1 schematically depicts an illustrative system for reducing an overpressure caused by an explosion of a vapor cloud, according to one or more embodiments described.

Referring to the FIG. 1, the system 100 can include one or more sensors (four are shown 110, 115, 120, and 125) operable or otherwise adapted or configured to detect a vapor cloud explosion. The system 100 can also include one or more igniters (four are shown 130, 140, 150, and 160) operable or otherwise adapted or configured to ignite the vapor cloud 101 to provide a discrete combustion site or combustion zone. The igniters 130, 140, 150, and 160 can be placed, positioned, or otherwise disposed at multiple locations throughout the vapor cloud 101. The discrete combustion zones can provide multiple discrete pressure waves that can reduce a size of an overpressure generated from the vapor cloud explosion. The discrete pressure waves originating from each discrete combustion zone can have a lower severity as compared to the severity of a single larger pressure wave that would form without combusting the vapor cloud at multiple locations, thereby reducing the overpressure caused by the vapor cloud explosion. The discrete combustion zones and the pressure waves originating therefrom can interact with one another, but these interactions can be such that the overpressure generated from the vapor cloud explosion combusted at multiple locations can be less than the overpressure generated from a single pressure wave that would develop if the vapor cloud was not combusted at multiple locations.

The vapor cloud 101 can be ignited at an ignition source 105 causing the vapor cloud explosion. The term "vapor cloud explosion" refers to the ignition and ensuing combustion of the vapor cloud 101 in the atmosphere. The ignition source 105 can be or include sparks, a hot surface, a runaway reaction reaching a temperature sufficient to cause a flame or sufficient heat capable of igniting the vapor cloud 101, lightning, an open flame, a temperature sufficient to cause the vapor cloud to auto ignite, e.g., a temperature of about 200° C. to about 500° C. or more, or any other source of energy sufficient to cause the vapor cloud 101 to ignite.

Vapor cloud explosions develop a high speed flame front that outwardly expands from the ignition source. The flame front travels at a rate of high speed resulting in deflagration and possibly detonation. Objects found within a facility such as pipes, buildings, vessels, and other structures when near or in the presence of the ignited vapor cloud, generate turbulence in the advancing flame front that produces a "pressure wave front" or "overpressure" or "pressure wave" ahead of the flame front. The terms "pressure wave front," "pressure wave," and "overpressure" are used interchangeably and refer to the increase in pressure caused by the expanding flame front relative to the atmospheric pressure. For example, if atmospheric or ambient pressure is 101 kPa (about 14.7 psia) and the pressure caused or exerted by the expanding flame front, i.e., the total pressure, is at 108 kPa (about 15.7 psia), the overpressure would be equal to 7 kPa (about 1 psia). Vapor cloud explosions can generate overpressures ranging from a low of about 1 kPa, about 3 kPa, about 5 kPa, about 7 kPa, or about 9 kPa to a high of about 30 kPa, about 50 kPa, about 70 kPa, about 85 kPa, or about 100 kPa or more. Vapor cloud explosions can generate overpressures, e.g., localized overpressures, of about 100 kPa or more, about 150 kPa or more, about 200 kPa or more, about 250 kPa or more, or about 300 kPa or more.

The vapor cloud 101 can be, include, or otherwise contain, one or more combustible vapors or gases. The vapor cloud can also contain droplets of combustible liquids, referred to as aerosols. As such, the vapor cloud can be composed of vapors, gases, aerosols, or a combination of vapors, gases, and/or aerosols. Conventionally, the term "vapor" refers to an air dispersion of molecules of a substance that is liquid or solid in its normal state, i.e., at standard temperature and pressure, the term "gas" refers to matter that exists in the gaseous state at standard temperature and pressure, and the term "aerosol" refers to a suspension of liquid or solid particles in a gas, with the particles often being in the colloidal size range, i.e., particles having a linear dimension of about 1 nm to about 100 nm. For purposes of this disclosure, however, the systems and methods for reducing an overpressure caused by a vapor cloud explosion are equally applicable to vapors, gases, and aerosols. As such, the terms "gas" and "vapor" are used interchangeably with one another and refer to matter or material in a gaseous state, but may also be or include matter or material in the form of an aerosol as well.

As used herein, the term "combustible" refers to any matter or material capable of being combusted or burned. As such, the terms "combustible vapor" and "combustible gas" refer to matter or material in a gaseous state capable of being combusted or burned and "combustible aerosol" refers to a suspension of liquid or solid particles in a gas capable of being combusted or burned. Further, the terms "combustible vapor," "combustible gas", as well as "combustible aerosol" can include matter or material derived from combustible liquids and/or flammable liquids. Combustible liquids have a flash point greater than about 37.7° C. (about 100° F.). Flammable liquids have a flash point less than about 37.7° C. and a vapor pressure that does not exceed 276 kPa (about 40 psia) at 37.7° C. For purposes of this disclosure, the systems and methods for reducing an overpressure caused by a vapor cloud explosion, i.e., combustion or burning of a vapor cloud, are equally applicable to gases, vapors, and/or aerosols derived from and/or containing combustible liquids and/or flammable liquids.

The sensors 110, 115, 120, and 125 can monitor and detect the presence of the vapor cloud 101 and/or the vapor cloud explosion. Vapor cloud explosions can exhibit several different characteristics or properties and any one or more of those properties can be detected by one or more of the sensors 110, 115, 120, and 125. For example, any one or more of the sensors 110, 115, 120, and 125 can detect the presence of a flame produced in the vapor cloud explosion, e.g., the flame that can develop at the ignition source 105, thus indicating the presence of a vapor cloud explosion. In addition to or in lieu of detecting the presence of the flame caused by combustion of the vapor cloud 101, any one or more of the sensors 110, 115, 120, and 125 can detect the presence of an increase in pressure caused by combustion of the vapor cloud 101. For example, one or more of the sensors 110, 115, 120, and 125 can detect the development and/or presence of the overpressure produced, generated, or otherwise caused by the expansion of the flame front formed during the vapor cloud explosion, thus indicating the presence of a vapor cloud explosion. In addition to or in lieu of detecting the presence of a flame and/or an increase in pressure caused by the combustion of the vapor cloud 101, any one or more of the sensors 110, 115, 120, and 125 can detect the presence of an acoustic sound indicative of a vapor cloud explosion. For example, one or more of the sensors 110, 115, 120, and 125 can detect the development or presence of an acoustic sound unique to a vapor cloud in the process of combusting, thus indicating the presence of a vapor cloud explosion. In addition to or in lieu of detecting the presence of a flame, an increase in pressure, and/or the presence of an acoustic sound caused by the combustion of the vapor cloud 101, any one or more of the sensors 110, 115, 120, and 125 can detect the presence of heat or thermal emission caused by the combustion of the vapor cloud 101. For example, one or more of the sensors 110, 115, 120, and 125 can detect the presence of heat indicative of a flame.

When one or more of the sensors 110, 115, 120, and 125 detect the presence of the vapor cloud explosion, one or more of the igniters 130, 140, 150, and 160 can be switched from an inactive or "off" state to an active or "on" state such that at least a portion of the vapor cloud 101 can be combusted at one or more locations, e.g., multiple locations, in addition to the flame produced at the ignition source 105. Preferably a plurality of the igniters 130, 140, 150, and 160, each located at a different point or location within the vapor cloud 101, can be switched from the "off" state to the "on" state when one or more of the sensors 110, 115, 120, and 125 detect the vapor cloud explosion. By switching a plurality of the igniters 130, 140, 150, and 160 to the "on" state, multiple combustion sites or combustion zones throughout the vapor cloud 101 can be produced. The multiple combustion zones can be formed or provided at the location of the igniters 130, 140, 150, and/or 160 that were switched to the "on" position.

The number of igniters 130, 140, 150, and 160 as well as the number of combustion sites that can be formed or generated via ignition of the vapor cloud 101 can range from a low of about 1, about 2, or about 3 to a high of about 20, about 30, about 50, about 70, about 85, or about 100 per 1,000 square meters (1,000 $m^2$) or more. The number of igniters 130, 140, 150, and 160, as well as the number of combustion sites that can be formed or generated via ignition of the vapor cloud 101, can range from a low of about 1, about 2, or about 3 to a high of about 20, about 30, about 50, about 70, about 85, or about 100 per 1,000 cubic meters (1,000 $m^3$).

The ignition of the vapor cloud 101 at multiple locations to produce the multiple combustion zones can reduce or limit the acceleration of the flame front caused by the vapor cloud explosion as compared to the acceleration in a comparative vapor cloud explosion allowed to explode without interference. The multiple combustion zones produced via the plurality of igniters 130, 140, 150, and 160 can each produce a separate and distinct flame front, and the multiple smaller flame fronts from the multiple combustion zones can counteract or collide with one another, before they can accelerate to flame speeds high enough to cause damaging overpressure, thus reducing the overpressure generated by the vapor cloud explosion. For example, the acceleration of the flame fronts in the multiple combustion zones can be limited to a maximum velocity of about 20 m/s, about 50 m/s, or about 150 m/s. In another example, the acceleration of the flame fronts can be limited to a maximum velocity of about 10 m/s, about 25 m/s, or about 70 m/s.

By reducing or limiting the speed of the flame front in the vapor cloud explosion, the average overpressure generated or produced by the vapor cloud explosion can be maintained at less than about 50 kPa, less than about 40 kPa, less than about 30 kPa, less than about 20 kPa, less than about 10 kPa, less than about 5 kPa, less than about 3 kPa, or less than about 1 kPa. Similarly, by reducing or limiting the speed of the flame front in the vapor cloud explosion, the average overpressure generated or produced by the individual combustion zones can be maintained at less than about 50 kPa, less than about 40 kPa, less than about 30 kPa, less than about 20 kPa, less than about 10 kPa, less than about 5 kPa, less than about 3 kPa, or less than about 1 kPa. In another example, by igniting the vapor cloud 101 at multiple locations throughout, the average overpressure generated or produced by the vapor cloud explosion can be limited to a maximum of about 45 kPa, about 30 kPa, about 20 kPa, about 15 kPa, about 10 kPa, or about 5 kPa. In another example, the average overpressure generated or produced by the vapor cloud explosion can range from about 1 kPa to about 25 kPa, about 5 kPa to about 20 kPa, about 3 kPa to about 15 kPa, or about 1 kPa to about 15 kPa.

The vapor cloud explosion can be detected within a time of about 3 seconds, about 2.5 seconds, about 2 seconds or less, about 1.5 seconds or less, about 1 second or less, about 0.8 seconds or less, about 0.6 seconds or less, about 0.4 seconds or less, about 0.2 seconds or less, about 0.1 seconds or less, about 0.05 seconds or less, about 0.01 seconds or less, or about 0.001 seconds or less after the vapor cloud explosion begins. Said another way, if initiation or development of the vapor cloud explosion at the ignition source 105 is considered to occur at time zero, the presence or existence of the vapor cloud explosion can be detected within about 3 seconds, about 2.5 seconds, about 2 seconds, about 1.5 seconds, about 1 second, about 0.8 seconds, about 0.6 seconds, about 0.4 seconds, about 0.2 seconds, about 0.1 seconds, about 0.05 seconds, about 0.01 seconds, or about 0.001 seconds of time zero. For example, the vapor cloud explosion can be detected within about 10 milliseconds (ms) to about 1 second, about 25 ms to about 500 ms, about 15 ms to about 250 ms, about 5 ms to about 100 ms, about 10 ms to about 75 ms, about 20 ms to about 50 ms, about 25 ms to about 40 ms, about 1 ms to about 10 ms, or about 1 ms to about 50 ms after the vapor cloud explosion begins, i.e., after time zero.

The time period or time lapse between the initiation of the vapor cloud explosion, i.e., time zero, and ignition of the vapor cloud at multiple locations throughout via the igniters 130, 140, 150, and 160 can be less than about 3 seconds, about 2.5 seconds, about 2 seconds, less than about 1.5 seconds, less than about 1 second, less than about 0.8 seconds, less than about 0.6 seconds, less than about 0.4 seconds, less than about 0.2 seconds, less than about 0.1 seconds, less than about 0.05 seconds, less than about 0.01 seconds, or less than about 0.001 seconds. Said another way, the detection of the presence or existence of the vapor cloud explosion can be counteracted by igniting the vapor cloud at multiple locations throughout within about 3 seconds, about 2.5 seconds, about 2 seconds, about 1.5 seconds, about 1 second, about 0.8 seconds, about 0.6 seconds, about 0.4 seconds, about 0.2 seconds, about 0.1 seconds, about 0.05 seconds, about 0.01 seconds, or about 0.001 seconds after detection of the vapor cloud explosion. For example, the detection of a vapor cloud explosion can be followed with ignition of the vapor cloud 101 at a plurality of locations within a time period ranging from about 10 milliseconds (ms) to about 1 second, about 25 ms to about 500 ms, about 15 ms to about 250 ms, about 5 ms to about 100 ms, about 10 ms to about 75 ms, about 20 ms to about 50 ms, about 25 ms to about 40 ms, about 1 ms to about 10 ms, or about 1 ms to about 50 ms.

The system can also include one or more controllers 175. The controller 175 can be in communication with the sensors 110, 115, 120, and 125 via lines 109, 114, 119, and 124, respectively, and the igniters 130, 140, 150, and 160 via lines 129, 139, 149, and 159, respectively. One or more of the sensors 110, 115, 120, and 125 and one or more of the igniters 130, 140, 150, and 160 can be positioned in a location susceptible to the formation of a vapor cloud 101. As shown, all of the sensors 110, 115, 120, and 125 and all of the igniters 130, 140, 150, and 160 are located within the vapor cloud 101. However, it should be noted that any one or more of the sensors 110, 115, 120, and 125 can be located outside of the vapor cloud.

One or more of the sensors 110, 115, 120, and 125 can transmit data intermittently and/or periodically via the communication lines 109, 114, 119, and 124, respectively, to the controller 175 indicating whether the presence of a vapor cloud explosion has been detected. In another example, the one or more sensors 110, 115, 120, and 125 can transmit data only when the presence of the flame 105 is detected or only when the presence of the flame 105 is not detected via lines 109, 114, 119, and 124, respectively, to the controller 175. The controller 175 can receive the data from one or more of the sensors 110, 115, 120, and 125 and based upon the data, at least in part, can communicate with one or more of the igniters 130, 140, 150, and 160 via the communication lines 129, 139, 149, and 159. For example, when the controller 175 does not receive data from one of the one or more sensors 110, 115, 120, and 125 or receives data indicating the absence of a vapor cloud explosion, the controller 175 can instruct the one or more igniters 130, 140, 150, and 160 to remain in the "off" state, i.e., to not produce a spark or other form of heat or energy capable of combusting the vapor cloud 101. In another example, when the controller 175 receives data from the one or more sensors 110, 115, 120, and 125 that the vapor cloud explosion has been detected, such information can be processed by the controller 175 and the controller can cause one or more of the igniters 130, 140, 150, and 160 to switch from the "off" state to the "on" state, i.e., to produce a spark or other form of heat or energy capable of combusting the vapor cloud 101.

The controller 175 can include one or more processors, relays, solid state relays, controllers, memory storage modules, and the like. As such, the methods and systems can be automated through appropriate hardware integrated with appropriate software and computer system. The basic operations, however, remain as described above. For example, the controller 175 can be or include one or more computers having a desired operating system and software. The controller can accept or receive data or other information from the sensors 110, 115, 120, and/or 125 and/or the igniters 130, 140, 150, and/or 160 as well as transmit or send data or other information to the 110, 115, 120, and/or 125 and/or the igniters 130, 140, 150, and/or 160. For example, the controller can receive optical, pressure, and/or acoustic information from the sensors 110, 115, 120, and/or 125 and can change the igniters 130, 140, 150, and/or 160 from an "off" state to an "on" state and/or an "on" state to an "off" state. In various embodiments, signal processing equipment is included between the detectors and sensors.

The communication lines or links 109, 114, 119, 124, 129, 139, 149, and 159 can be physical connections and/or wireless connections. Physical connections can include, but are not limited to, fiber optic cables, electrical cables, fluid transmission lines such as pneumatic or hydraulic fluid transfer lines, or any combination thereof. Wireless connections can include, but are not limited to, transmission of electromagnetic signals, transmission of pneumatic signals, or any combination thereof. Electromagnetic signals can include, but are not limited to, radio waves, sound waves, microwaves, infrared radiation, visible light, ultraviolet radiation, X-rays, gamma rays, or any combination thereof. The communication via any one of lines 109, 114, 119, 124, 129, 139, 149, and 159 can be an analog and/or digital communication signals.

Although not shown, one or more of the sensors 110, 115, 120, and 125 can be in direct communication with one or more of the igniters 130, 140, 150, and 160, thus eliminating the need for the controller 175. Said another way, any one or more of the sensors 110, 115, 120, and/or 125 can be in communication with any one or more of the igniters 130, 140, 150, and 160 such that one or more of the sensors can cause one or more of the igniters to switch between and "off" state and an "on" state and vice versa.

Any suitable optical detection or measuring system, device, or combination of systems and/or devices can be used to monitor a location for the presence of a flame caused by combustion of the vapor cloud. For example, the presence of a flame caused by combustion of a vapor cloud can be detected via one or more optical sensors. The optical sensor can detect light emitted from the flame caused by combustion of the vapor cloud. For example, the optical sensor can identify or detect the one or more variations in illumination intensities attributable to the turbulent flickering of flames caused by the combustion of vapor clouds. The optical sensor can be configured to detect infrared (IR) radiation (a wavelength ranging from about 0.74 μm to about 300 μm), visible radiation (a wavelength ranging from about 390 nm to about 750 nm), ultra violet (UV) radiation (a wavelength ranging from about 10 nm to about 400 nm), or any combination thereof that can be emitted or given off from a flame caused by combustion of a vapor cloud.

One particularly useful optical sensor can be or include an optical sensor configured to detect light at two or more wavelengths, e.g., IR/UV, IR/IR, and IR/IR/IR wavelengths. For example, the simultaneous detection of light at two or more wavelengths can reduce false alarms caused by common light sources such as welding, x-rays, lightning, artificial lighting, and/or interrupted hot body radiation. For example, a multi-wavelength optical sensor can compare the threshold signal in two distinct spectral ranges and their ratio to each other can be used to confirm the reliability of the detected light signal.

Optical sensors configured to detect light at predetermined wavelengths or narrow ranges of wavelengths can also be preferable for the detection of a flame caused by the combustion of a vapor cloud. More particularly, the illumination intensity can be measured in a wavelength range that is characteristic to particular combustion processes. For example, a wavelength around 4.5 μm can be a preferred wavelength because emission of carbon monoxide radicals during combustion is at this wavelength. By focusing or limiting the optical sensor to detection within predetermined wavelengths the sensitivity of the optical sensor to light sources not caused by combustion (e.g., electric light and reflections of sunlight) can be reduced, thus reducing the potential for false alarms. Any number of wavelengths or selected wavelength ranges can be used to detect a flame caused by the combustion of a vapor cloud.

The distance between any two adjacent optical sensors can range from a low of about 1 m, about 3 m, about 5 m, or about 10 m to a high of about 30 m, about 45 m, about 60 m, or about 75 m. For example, adjacent optical sensors can be spaced apart from one another a distance of about 3 m to about 60 m, about 1 m to about 10 m, about 25 m to about 55 m, about 15 m to about 30 m, or about 30 m to about 70 m.

Any suitable pressure detection or measuring system, device, or combination of systems and/or devices can be used to monitor a location for the presence of an overpressure caused by the combustion of the vapor cloud. One type of suitable pressure sensor can be or include a pressure transducer that can convert pressure into an analog electrical signal. One type of pressure transducer can be a strain-gage based transducer that can convert pressure into an electrical signal by the physical deformation of strain gages bonded into a diaphragm of the pressure transducer and wired into a Wheatstone bridge configuration. Pressure applied to the pressure transducer produces a deflection of the diaphragm that introduces strain to the gages and the strain produces an electrical resistance change proportional to the pressure.

The pressure sensor can be configured to allow for non-vapor cloud explosion related pressure increases such as a change in atmospheric pressure, thus, reducing the likelihood of and/or avoiding false alarms. For example, the pressure sensor can be required to detect a minimum increase in pressure to differentiate between the presence of an overpressure and a change in atmospheric pressure. In another example, the pressure sensor can be required to detect a minimum increase in pressure over a predetermined time interval, e.g., an increase of about 0.5 kPa or about 1 kPa within a time of less than about 20 milliseconds (ms), to differentiate between the presence of an overpressure and a change in atmospheric pressure. For example, the pressure sensor can be required to detect a minimum increase in pressure over a predetermined time interval of about 20 ms of about 0.2 kPa, about 0.5 kPa, about 0.8 kPa, about 1 kPa, about 1.3 kPa, about 1.5 kPa, about 1.7 kPa, or about 2 kPa, to differentiate between the presence of an overpressure and a change in atmospheric pressure, wind gusts, or other potential pressure changes not attributable to a vapor cloud explosion. The pressure sensor can also be at least partially shielded from direct contact from rain, falling debris, or contract by other material by locating the pressure sensor within and/or below a housing or cover ("rain" shield). The pressure sensor can also be mounted on a platform or other structure capable of absorbing or reducing normal vibrations, e.g., vibrations caused by machinery, vehicles, and/or process equipment, from being transferred to the pressure sensor.

In at least one embodiment, when the location is monitored for a pressure increase caused from a vapor cloud explosion, at least two pressure sensors can be used in conjunction with one another. To further reduce possible false alarms two or more pressure sensors can also be required to detect or measure an increase in pressure that can be indicative of a vapor cloud explosion in order to confirm the presence of a vapor cloud explosion. Preferably at least two pressure sensors can be located a distance of at least 1 m, at least 3 m, at least 5 m, at least 7 m, at least 10 m, at least 12 m, at least 15 m, at least 17 m, or at least 20 meters away from one another. Requiring at least two pressure sensors located a given distance away from one another can reduce the probability of a false alarm caused by direct contact to one pressure sensor and/or a localized atmospheric pressure change around one pressure sensor, e.g., a pressure relief valve on a small gas cylinder being activated, or the like. The number of pressure sensors required to detect an overpressure or pressure increase caused by a vapor cloud explosion can be 1, 2, 5, 10, 20, 30, 50, 70, 90, 100, or more.

Any suitable acoustic detection or measuring system, device, or combination of systems and/or devices can be used to monitor a location for the presence of an acoustic emission generated or caused by the vapor cloud explosion. For example, the acoustic sensor can include a microphone capable of detecting one or more unique sound or noise patterns caused by combustion of the vapor cloud. For example, an output of the microphone could be analyzed for characteristic patterns via a computer or other processor.

Any suitable heat or thermal detection or measuring system, device, or combination of systems and/or devices can be used to monitor a location for the presence of heat or thermal emission that can be generated or caused by a vapor cloud explosion. For example, a fusible cable can be used to monitor an area. When subjected to a sufficient amount of heat for a sufficient amount of time the fusible cable can be molten and interrupt an electric current flowing therethrough, which can indicate the presence of a flame or other heat generated from a vapor cloud explosion. One example of an emerging technology can include, but is not limited to, the Fiber Optic Linear Heat Detection System, available from AP Sensing. This sensing system can include cables several thousand meters long and can detect, quantify, and localize temperatures along the length of the cable within 10 seconds or less.

Any suitable igniter system, device, or combination of systems and/or devices can be used to ignite combustible and/or flammable vapors contained in the vapor cloud that has not already been combusted due to the traveling flame front to produce one or more localized combustion sites. One type of igniter can be, or include, a device capable of generating a spark having a sufficient amount of energy to cause combustion of the combustible vapor remaining in the vapor cloud. For example, the igniter can be a spark plug. Another type of igniter can be or include a flame generating device. For example, the igniter can be a torch or other device that can burn a combustible gas supplied thereto causing a flame. Another type of igniter can be, or include, a hot glowing wire and/or an exploding fuse wire. Igniters using electrical energy to ignite the vapor cloud can be combined with local energy sources that release the energy within the time needed to cause ignition of the vapor cloud, e.g., with electrical capacitors having a capacity consistent with the needed ignition energy.

The igniter can be capable of generating a spark, flame, or other source of heat having about 0.001 Joule or more, about 0.01 Joule or more, about 0.1 Joule or more, about 5 Joules or more, about 10 Joule or more, about 20 Joule or more, about 30 Joule or more, about 50 Joule or more, about 70 Joule or more, about 85 Joule or more, or about 100 Joule or more. For example, the igniter can be capable of generating a spark, flame, or other source of heat having about 0.01 Joule to about 80 Joules, or about 1 Joule to about 20 Joules, or about 25 Joules to about 75 Joules, or about 10 Joules to about 60 Joules, or about 35 Joules to about 90 Joules.

In one or more embodiments, a combination of two or more different types of sensors, e.g., optical, pressure, and/or acoustic, can be used to monitor the location for the presence of a vapor cloud explosion. For example, if two or more different types of sensors are used, e.g., a first sensor such as an optical sensor and a second sensor such as a pressure sensor, ignition of the vapor cloud at one or more locations, after the detection of the vapor cloud explosion, can require detection of the vapor cloud by each of the two or more different sensors, i.e., both the first sensor and the second sensor.

When a plurality of sensors, e.g., optical, pressure, and/or acoustic, are used to detect the presence of the vapor cloud explosion, the distance between any two adjacent sensors can be the same or different with respect to any other two adjacent sensors. Similarly, when a plurality of igniters are used to initiate combustion of at least a portion of any remaining vapor cloud that has not been combusted, the distance between any two adjacent igniters can be the same or different with respect to any other two adjacent igniters. The distance between any two adjacent sensors and/or igniters can range from a low of about 1 m, about 5 m, or about 10 m to a high of about 20 m, about 30 m, or about 40 m. For example, the distance between any two adjacent sensors and/or igniters can range from about 1 m to about 10 m, about 3 m to about 15 m, about 10 m to about 20 m, about 5 m to about 20 m, about 15 m to about 35 m, or about 7 m to about 23 m. Depending on the particular type of sensor(s) used, the average distance between any two adjacent sensors can be less than or greater than the average distance between any two adjacent igniters. Said another way, the number of sensors capable of monitoring a given location, i.e., a predetermined area or volume, for the presence of a vapor cloud explosion can be less than the number of igniters required to combust at least a portion of any remaining vapor in a vapor cloud undergoing combustion. As such, the distance between any two adjacent sensors can range from a low of about 1 m, about 10 m, about 20 m, about 30 m, or about 40 m to a high of about 75 m, about 100 m, about 125 m, or about 150 m.

The distance between any given adjacent igniters, e.g., igniters 130 and 140, can be the same or different with respect to any other adjacent igniters, e.g., 130 and 150. For example, the number of igniters within a given area or volume can increase in places more likely to contribute to acceleration of the flame front as compared to places less likely to contribute to acceleration of the flame front. In another example, the distance between a first set of igniters, e.g., 130 and 140, can be the same or different with respect to the distance between a second set of igniters, e.g., 130 and 150 or 150 and 160. In another example, the distance between a first set of igniters, e.g., 130 and 140, can be the same with respect to the distance between a second set of igniters, e.g., 130 and 150, and different with respect to the distance between a third set of igniters, e.g., 140 and 160.

The igniters 130, 140, 150, and 160 can be located at the same elevation and/or at different elevations with respect to one another. For example, the igniters 130, 140, 150, and 160 can all be located at the same elevation or within the same horizontal plane with respect to one another. In another example, the igniters 130, 140, 150, and 160 can each be located at a different elevation or in different horizontal planes with respect to one another. In another example, the elevation of a first igniter, e.g., 130, can be the same or different with respect to the elevation of a second igniter, e.g., 160. In another example, the elevation of a first igniter, e.g., 130, can be the same with respect to the elevation of a second igniter, e.g., 160, and different with respect to a third igniter, e.g., 150.

Any two or more of the igniters 130, 140, 150, and 160 can be switched from the "off" state to the "on" state at the same time or at different times with respect to one another. In another example, the igniters 130, 140, 150, 160 can be switched from the "off" state to the "on" state within a time period ranging from a low of about 1 ms, about 3 ms, or about 5 ms to a high of about 10 ms, about 25 ms, about 50 ms, about 75 ms, or about 100 ms.

A wide variety of different combustible and flammable compounds exist that can potentially be present within a vapor cloud capable of being ignited and thus present as a combustion source in a vapor cloud explosion. An illustrative list of compounds that can be present in a vapor cloud capable of combusting can include, but are not limited to, 1,3-butadiene, acetaldehyde, acetic acid (glacial), acetone, acetonitrile, acrylonitrile, ammonia (anhydrous), amyl acetate, amylamine (mono), benzene, butane-n, butene-1, butyl acetate-n, butyl alcohol-n, butyl alcohol-sec, butyl alcohol-tert, cyclohexane, decane-n, diethyl ether, dimethylformamide, dimethylamine, dimethylamine anhydrous, dioxane-p, dodecane-n, ethane, ethyl alcohol, ethyl benzene, ethyl ether, ethylamine, ethylene, ethylene oxide, formaldehyde gas, gasolines, heptane-n, hexane-n, hydrogen, isobutene, isoprene, isopropyl alcohol, isopropyl ether, isopropylamine, jet fuels, methane, methyl alcohol, methyl ethyl ketone, methyl methacrylate, methylchloride, naphtha, octane-n, pentane-n, propane, propyl acetate-n, propyl alcohol-iso, propyl alcohol-n, propylamine-n, propylbenzene-n, propylene, propylene oxide, styrene, tetradecane-n, tetrahydrofuran, tetrahydrofurfuryl alcohol, toluene, triethylamine, trimethylamine, vinyl acetate, vinyl chloride, vinyl ethyl ether, xylene-m, xylene-o, xylene-p, or any combination thereof.

Due to the wide range of combustible compounds that can potentially form the vapor cloud 101, the types of facilities that can be subject to vapor cloud explosions are numerous. Said another way, the facilities that can be subject to the presence of the vapor cloud 101 and the damages associated with the explosion thereof, can include any facility that a vapor cloud containing one or more combustible vapors can form. Facilities susceptible to the formation of the vapor cloud 101 can include, but are not limited to, hydrocarbon and/or chemical extraction or production facilities, hydrocarbon and/or chemical processing facilities, hydrocarbon and/or chemical refining facilities, hydrocarbon and/or chemical storage facilities, and/or hydrocarbon and/or chemical transportation vehicles. For example, one type of facility can be a hydrocarbon production facility at which gaseous and/or liquid hydrocarbons are extracted from the earth. In another example, the facility can include a hydrocarbon processing facility such as a liquid natural gas (LNG) receiving and distribution facility. In another example, the facility can include a hydrocarbon refining facility at which gasification, cracking, polymerization, or other hydrocarbon refining processes can be carried out. Other locations can include, but are not limited to, welding facilities or other facilities where sufficient quantities of combustible gases capable of forming a vapor cloud if uncontrollably released are stored and/or consumed, e.g., about 100 kg, about 1,000 kg, about 10,000 kg, about 100,000 kg, about 200,000 kg or more. Another facility can include at least one location at which one or more combustible vapors is processed or stored. In another example, the facility can include, but is not limited to, a hydrocarbon production facility, a hydrocarbon processing facility, a hydrocarbon refining facility, a hydrocarbon storage facility, or any combination thereof. As such, the locations susceptible to experiencing vapor cloud explosions can be located on land, above land, within underground facilities, on floating structures, within structures on or below the surface of bodies of water, and/or within and/or about a vehicle such as a pipeline, reactor, storage container, tanker ship, rail car, tanker truck, tanker ship, or the like.

Any size vapor cloud can be detected and ignited at a plurality of points disposed throughout at least a portion of any remaining vapor cloud not already combusted to produce a plurality of localized combustion sites. For example, the amount of combustible vapor that can be contained in the vapor cloud when the vapor cloud explosion begins can range from a low of about 50 kg, about 100 kg, about 500 kg, or about 1,000 kg to a high of about 20,000 kg, about 30,000 kg, about 40,000 kg, about 50,000 kg, or more. The area that can be monitored by the sensors and occupied by the igniters can range from a low of about 10 $m^2$, about 100 $m^2$, about 1,000 $m^2$, about 10,000 $m^2$, or about 50,000 $m^2$ to a high of about 0.1 $km^2$, about 1 $km^2$, about 2 $km^2$, about 3 $km^2$, or about 5 $km^2$.

EXAMPLES

A series of vapor cloud explosion (VCE) tests were conducted utilizing multiple simultaneous ignition sources using near stoichiometric homogenous propane-air mixtures. Table 1 summarizes the test matrix employed.

TABLE 1

Test Matrix

| Test Series | Number of Ignition Locations | Maximum Flame Travel Distance (ft) | Congestion Level | Flame Expansion | Test Rig Dimensions |
|---|---|---|---|---|---|
| Z01 | 1-Center | 17 | Medium | 3D | 24 ft × |
| A | 1-Edge | 27 | | | 24 ft × |
| B | 2-Edge | 17 | | | 6 ft |
| C | 4-Edge | 12 | | | 7.3 m × |

TABLE 1-continued

| Test Matrix | | | | | |
|---|---|---|---|---|---|
| Test Series | Number of Ignition Locations | Maximum Flame Travel Distance (ft) | Congestion Level | Flame Expansion | Test Rig Dimensions |
| D | 5-(4 edge + 1 center) | 12 | | | 7.3 m × 1.8 m |
| E | 5-Interior | 8.5 | | | |
| F | 2-Corner | 24 | | | |

The "maximum flame travel distance" is the longest distance a flame can travel between an ignition source before encountering the flame front from another ignition source (assuming equal flame speeds) or the edge of the test rig, whichever is greater. The maximum flame travel distances for each test series are given in Table 1.

The test rig was employed a 4×4 cube configuration (24 ft×24 ft×6 ft), with a medium level of congestion and 3D flame expansion (i.e., open roof and sides). A medium congestion level was created by using a 7×7 array of 2 inch (5 cm) PVC pipes oriented vertically within a cube, for a total of 49 obstacles per cube. This arrangement yields a congestion pitch-to-diameter ratio of 4.3 and provides area and volume blockage ratios of 23% and 4.3%, respectively. A 1 mil (0.025 mm) plastic sheet was placed over the rig, in order to allow the rig to be filled with a flammable mixture (e.g., propane); with the plastic released via a set of actuators just prior to ignition.

Propane was introduced into the test rig via eight venturis, placed at a height of 3 ft. The venturis were oriented to pull from the bottom of the rig and expel the mixture up and toward the top of the rig. Gas flow to the venturis was controlled by four solenoid valves, which allowed the rig to be broken into four independent quadrants, containing two venturis each. Independent control of these zones promoted the development of a uniform propane-air mixture within the test rig. Fans were used to circulate the fuel-air mixture within the rig in order to promote the formation of a uniform mixture throughout the test rig. The fuel concentration within the test rig was monitored using a California Analytical 600P oxygen analyzer. The ignition system was composed of five equal length wire leads and up to five exploding fuse wires, each 5 cm long (Parr Instrument Company, Moline, Ill., Part No. 45C10). The fuse wire had a heat of combustion of 9.6 J/cm.

Pressure-time histories, as well as high speed (1000 fps) and high definition (30 fps) video data, were collected for each test. The pressure measurement system setup contained dynamic pressure gauges and line-powered ICP™ sensor signal conditioners, available from PCB Piezotronics of Depew, N.Y. Each pressure gauge was mounted on a ½-inch steel plate. The PCB Piezotronics general purpose ICP™ pressure sensors (Model 102B18) were connected to a line-powered ICP™ sensor signal conditioner. The pressure sensors were amplified with the signal conditioners based on the expected pressure at each gauge location. Each pressure sensor was sampled by a PC-based data acquisition system at 10,000 samples per second using a LabView VI PXI system, available from National Instruments Corporation of Austin, Tex.

Test Series Z01 is based upon an ignition source at the center of the test rig. It is an average of a series of at least three tests and is used as comparative baseline in TABLE 2. Three tests were also conducted for each configuration of ignition points (Test Series A-F). The results are discussed below.

Test Series A

Figure 2:
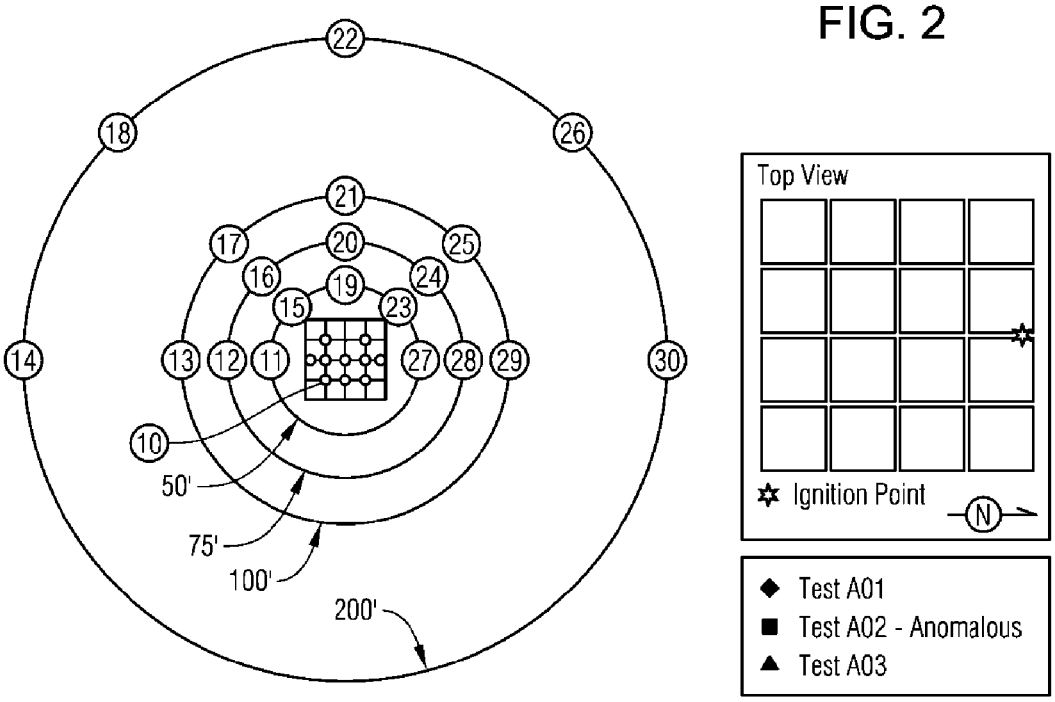
FIG. 2 presents a plot of measured peak pressures for the tests of Test Series A.
Figure 2:
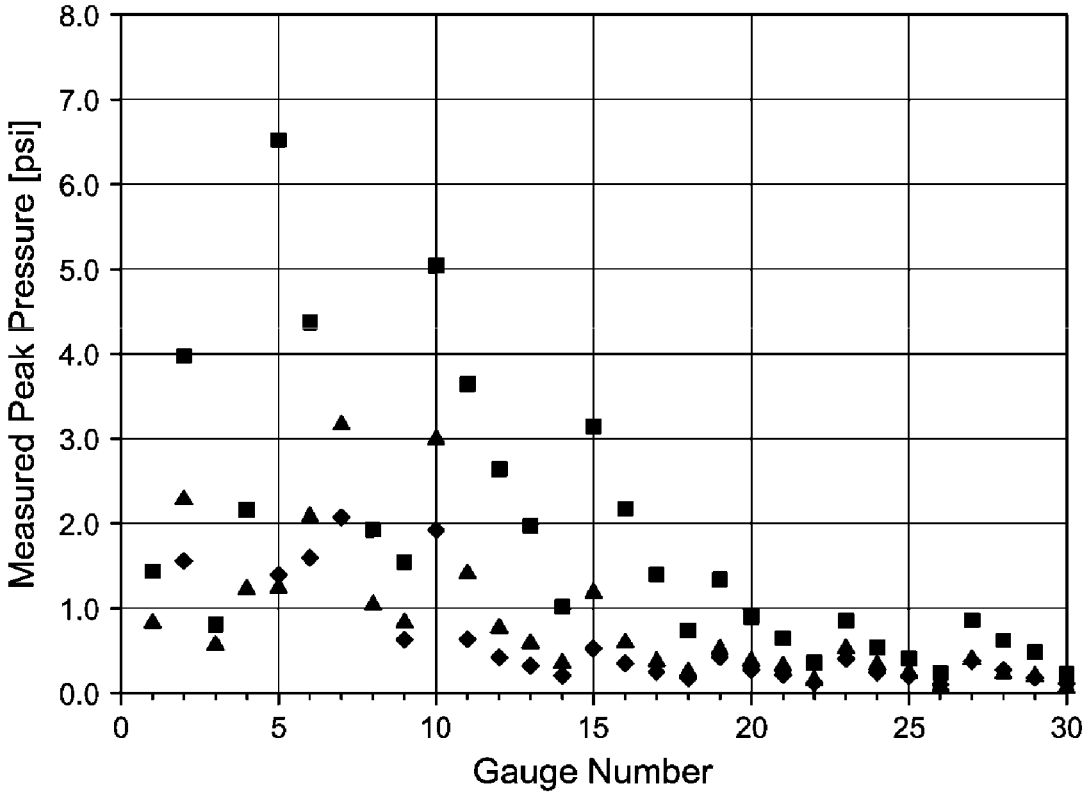

With reference to FIG. 2, Test Series A utilized a single ignition source placed at the middle of the north side of the test rig. The peak pressures measured along each of the five exterior gauge lanes reflected the directional nature of the flame propagation.

Test Series B

Figure 3:
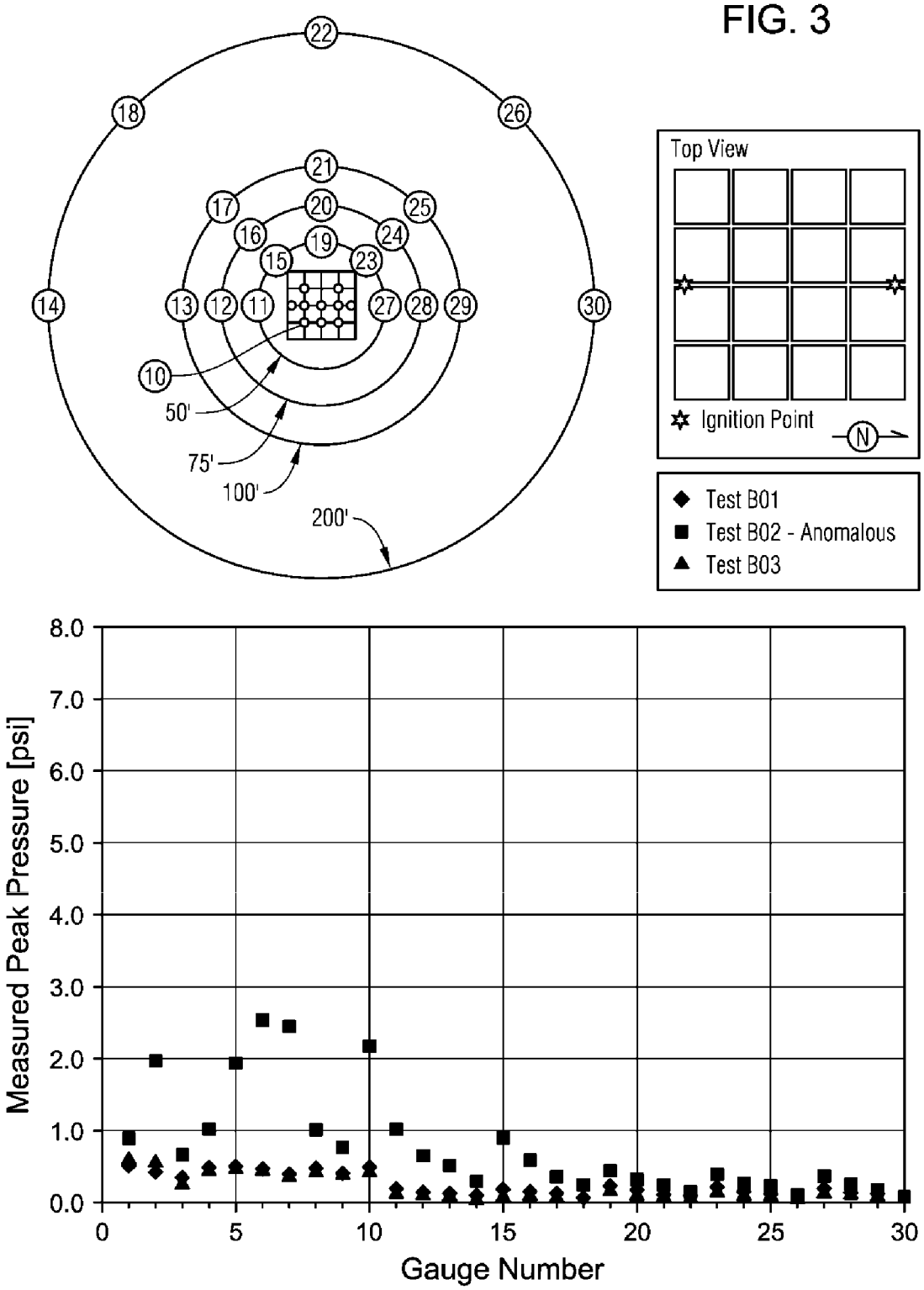
FIG. 3 presents a plot of measured peak pressures for the tests of Test Series B.

With reference to FIG. 3, Test Series B utilized two ignition sources, with one source located at the middle of the north side of the test rig and one located at the middle of the south side. The addition of the second ignition source resulted in a 70% reduction in the peak pressures relative to those in Test Series A (see Table 4). Symmetric flame propagation from the two ignition sources also yielded better agreement among the five exterior gauge lanes, as can be seen by comparing FIG. 3 with FIG. 2. Test B02 was anomalous due to a concentration gradient between the north and south half of the test rig, which resulted in asymmetric flame propagation from the two ignition points.

Test Series C

Figure 4:
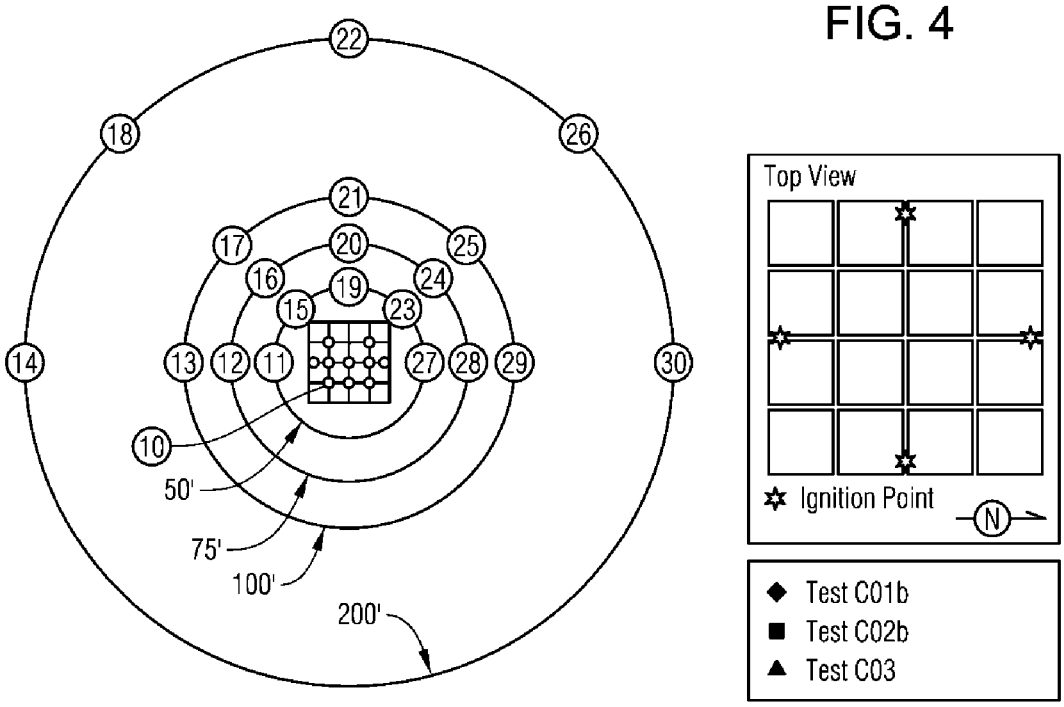
FIG. 4 presents a plot of measured peak pressures for the tests of Test Series C.
Figure 4:
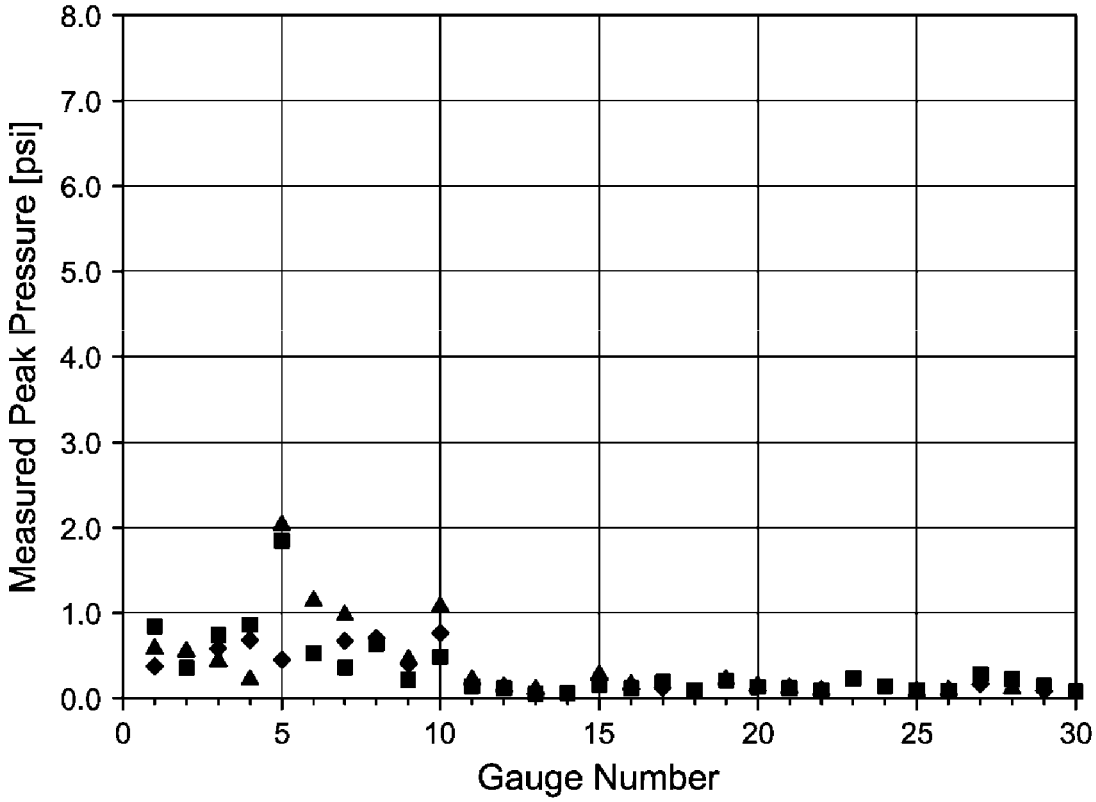

With reference to FIG. 4, Test Series C utilized four ignition sources, with one at the middle of each side of the test rig. The addition of two additional ignition sources along the east and west edges of the test rig resulted in 60% lower peak pressures than those seen in Test Series A, as shown in Table 4. Symmetric flame propagation from the four ignition sources also yielded better agreement among the five exterior gauge lanes, as can be seen by comparing FIG. 2 and FIG. 4.

Test Series D

Figure 5:
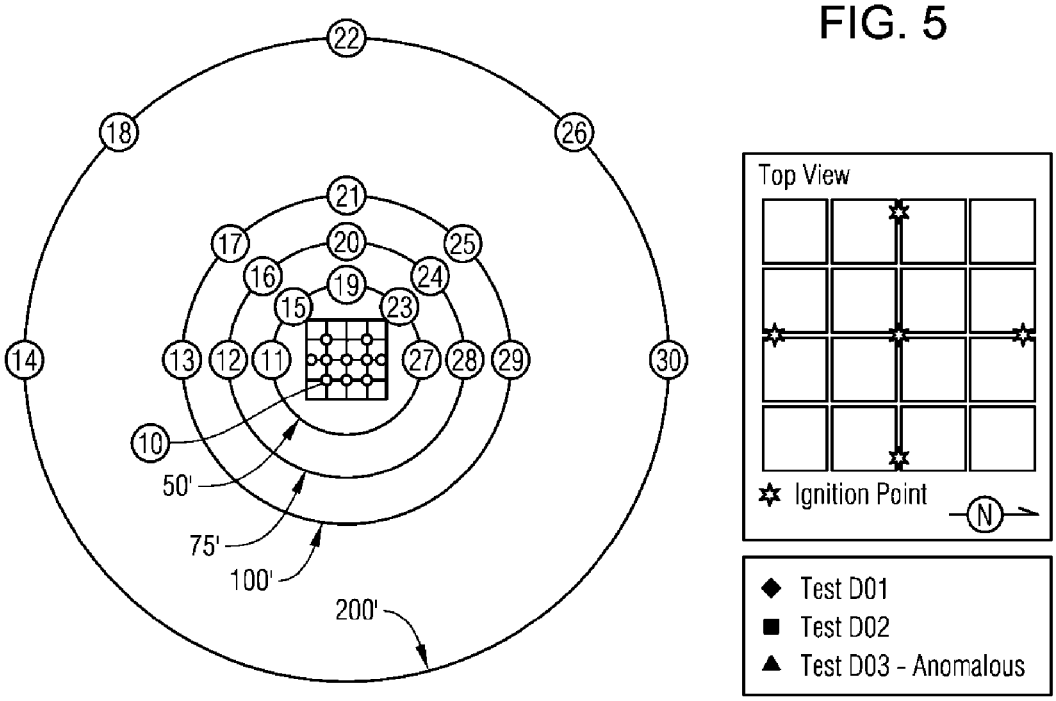
FIG. 5 presents a plot of measured peak pressures for the tests of Test Series D.
Figure 5:
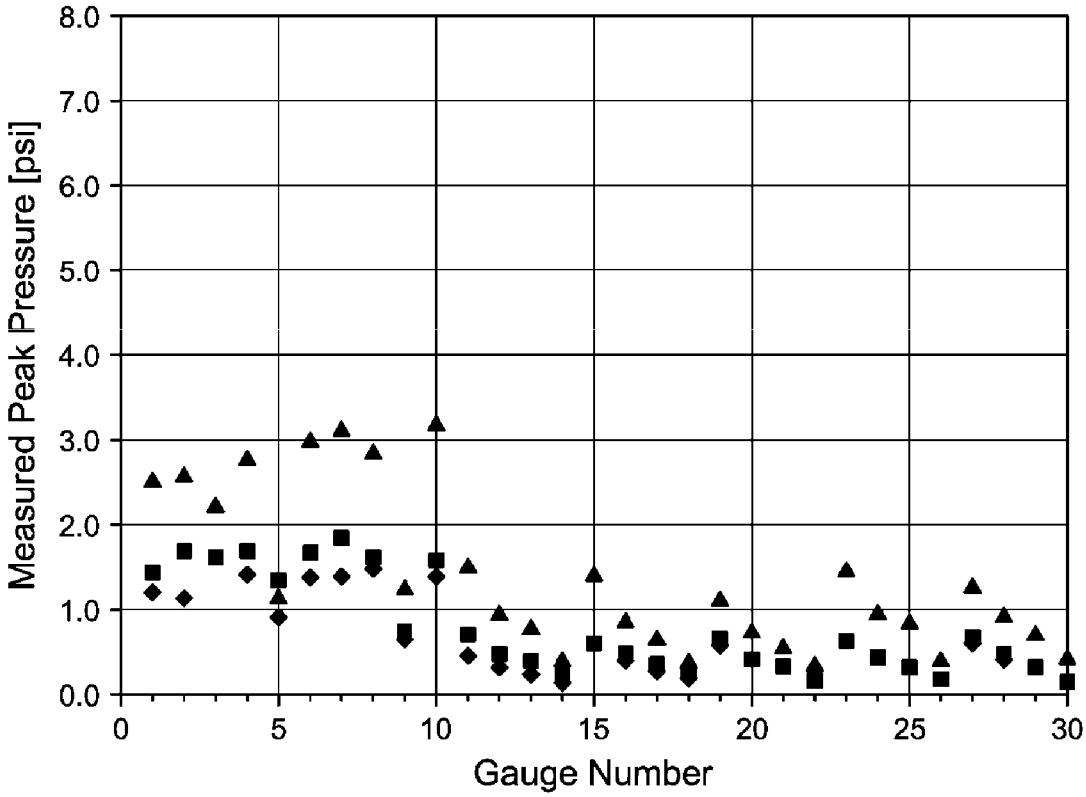

With reference to FIG. 5, Test Series D utilized five ignition sources, with one at the middle of each side of the test rig and a fifth ignition source at the rig center. The addition of a fifth ignition location at the rig center (i.e., vs. Test Series C) resulted in average peak far-field pressure measurements that were within 5% of those for Test Series A (single edge ignition). Symmetric flame propagation from the five ignition sources also resulted in fairly uniform pressure measurements along the five exterior gauge lanes, as can be seen in FIG. 5. Test D03 was anomalous due to a rich propane concentration in quadrant 3 of the test rig, which yielded slightly elevated peak pressures.

Test Series E

Figure 6:
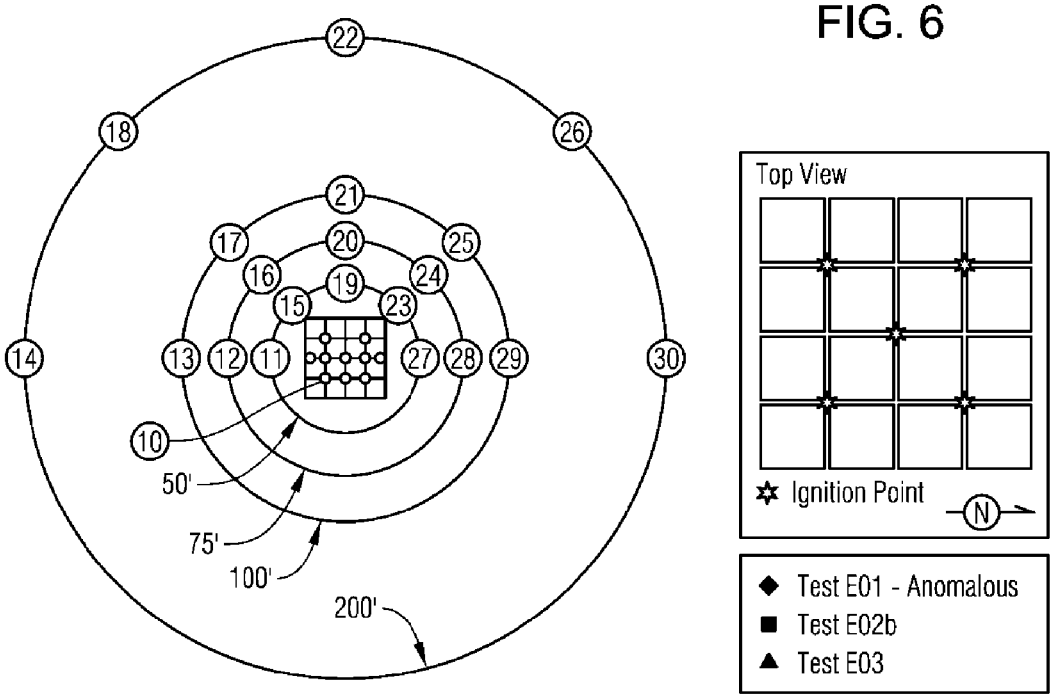
FIG. 6 presents a plot of measured peak pressures for the tests of Test Series E.
Figure 6:
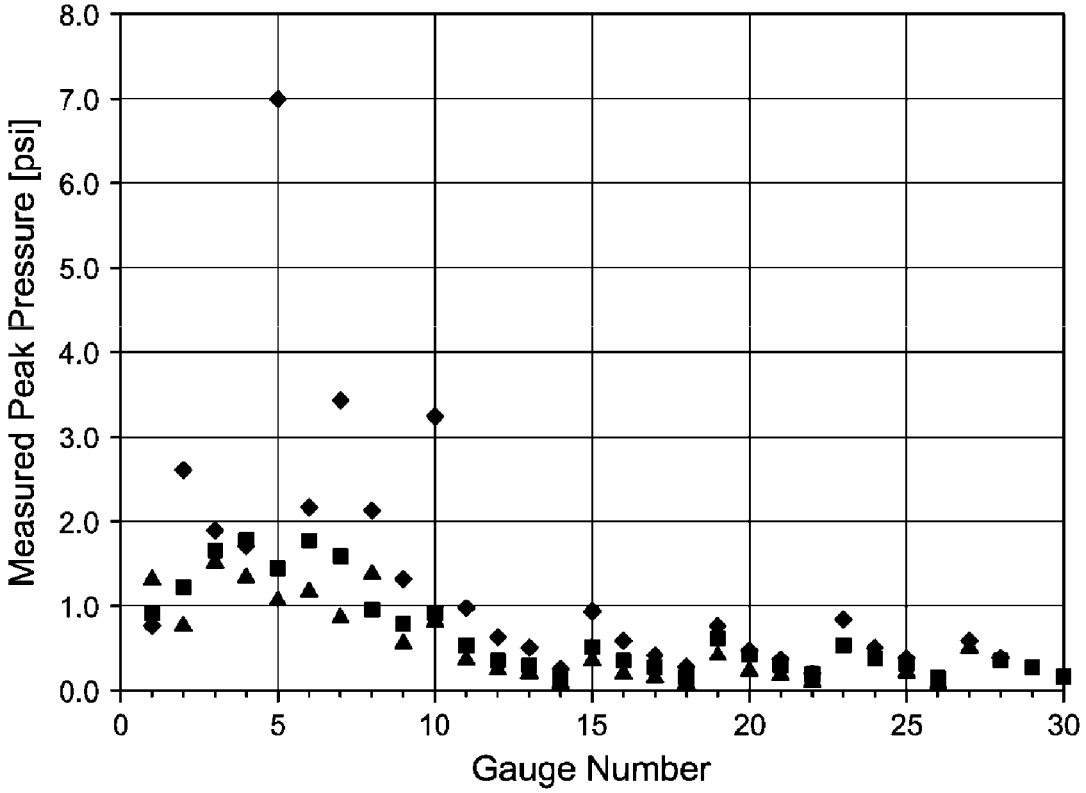

With reference to FIG. 6, Test Series E sought to develop additional information regarding the impact of number of ignition sources and maximum flame travel distance. In Test Series E, the four edge ignition sources from the Test Series D were relocated to the rig quadrant centroids. Far-field peak pressures for Test Series E were roughly 20% less than those for Test Series D.

The expanding flame front from the center ignition of Test Series D outpaced the flame fronts from the four outer edge ignitions and consumed much of the flammable mixture in the rig. Moving the edge ignitions into the rig quadrant centroids resulted in more of the flammable mixture being consumed by the flame fronts from the edge ignition locations. The flame from the center ignition was not able to accelerate as aggressively in Test Series E before encountering the flame fronts from the other four ignitions locations, and hence more of the flammable mixture was consumed at a lower flame speed in Test Series E than in Test Series D.

Test Series F

Figure 7:
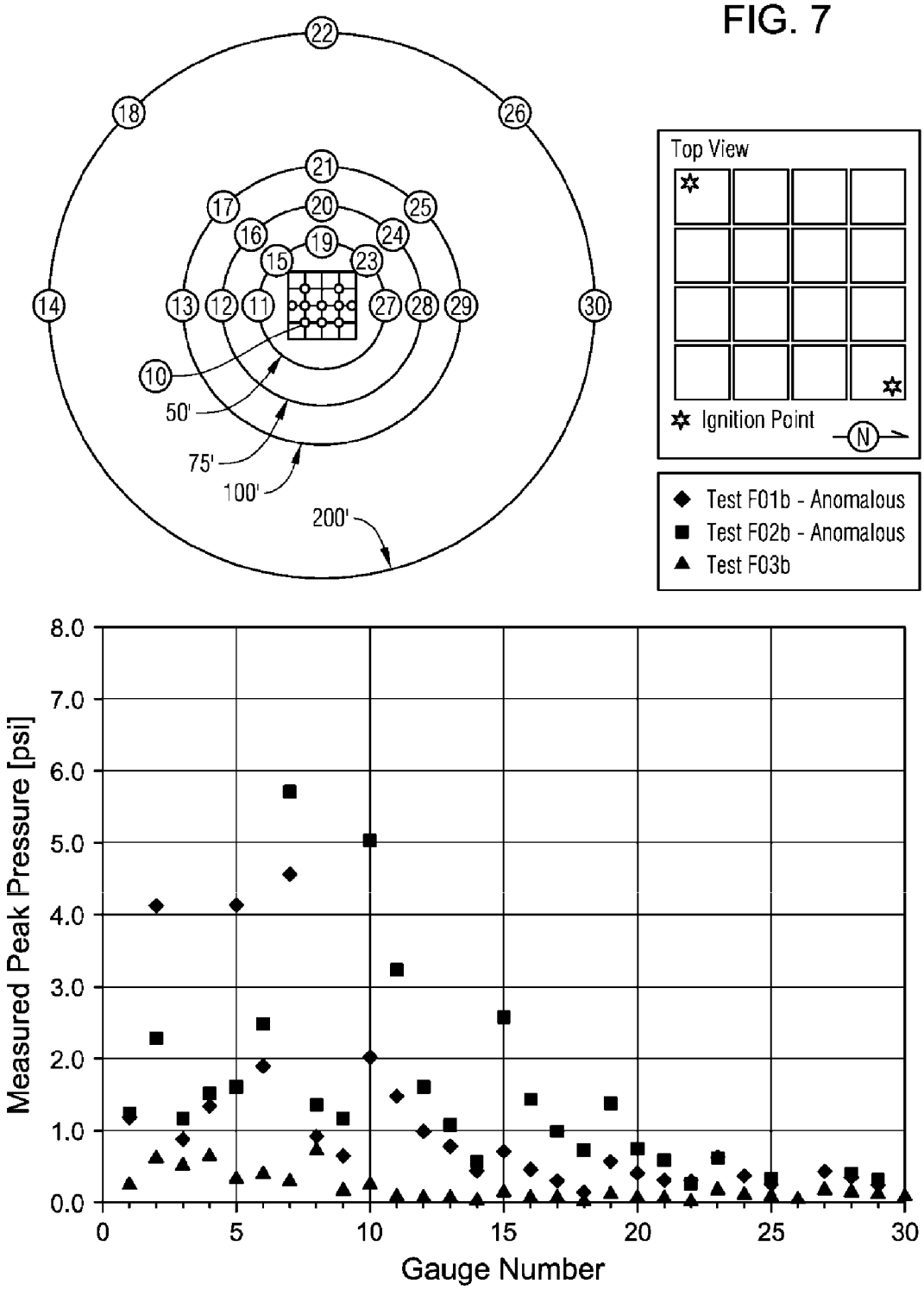
FIG. 7 presents a plot of measured peak pressures for the tests of Test Series F.

With reference to FIG. 7, Test Series F was a variant of Test Series B, but with the two ignition sources moved from the edges to opposite corners, in order increase the distance between the two ignition sources and the resultant flame travel distance. While this might be expected to increase the resultant overpressure by increasing peak flame speed, the impact of back venting on flame propagation can act to limit the flame speed achieved during the early portion of the flame propagation for this configuration.

Test Results

Table 2, below, summarizes the average peak pressures recorded for each test series at 75, 100, and 200 feet from the center of the test rig, with anomalous tests and pressure readings excluded from these averages.

TABLE 2

Comparison of Average Far-Field Pressures

| Distance from | Peak Pressure [psi] | | | | | | |
|---|---|---|---|---|---|---|---|
| Rig Center [ft] | A-Series | B-Series | C-Series | D-Series | E-Series | F-Series | Z01 |
| 75 | 0.40 | 0.12 | 0.15 | 0.41 | 0.34 | 0.11 | 0.76 |
| 100 | 0.30 | 0.10 | 0.11 | 0.31 | 0.26 | 0.09 | 0.59 |
| 200 | 0.16 | 0.05 | 0.06 | 0.17 | 0.14 | 0.05 | 0.32 |

Table 3, below, gives the reduction in average peak pressure for each configuration relative to that of a single center ignition (i.e., Test Z01).

TABLE 3

Reduction in Average Peak Pressure versus Single Center Ignition

| Distance from Rig Center [ft] | A-Series | B-Series | C-Series | D-Series | E-Series | F-Series |
|---|---|---|---|---|---|---|
| 5 | 47% | 84% | 80% | 46% | 55% | 86% |
| 100 | 49% | 84% | 81% | 47% | 56% | 85% |
| 200 | 48% | 84% | 80% | 47% | 57% | 85% |

Table 4, below, gives the reduction in average peak pressure for each configuration relative to that a single edge ignition (i.e., Test Series A).

TABLE 4

Reduction in Average Peak Pressure versus Single Edge Ignition

| Distance from Rig Center [ft] | B-Series | C-Series | D-Series | E-Series | F-Series | Z01 |
|---|---|---|---|---|---|---|
| 75 | 69% | 63% | −2% | 16% | 73% | −89% |
| 100 | 68% | 63% | −4% | 14% | 72% | −95% |
| 200 | 69% | 62% | −3% | 16% | 72% | −94% |

Figure 8:
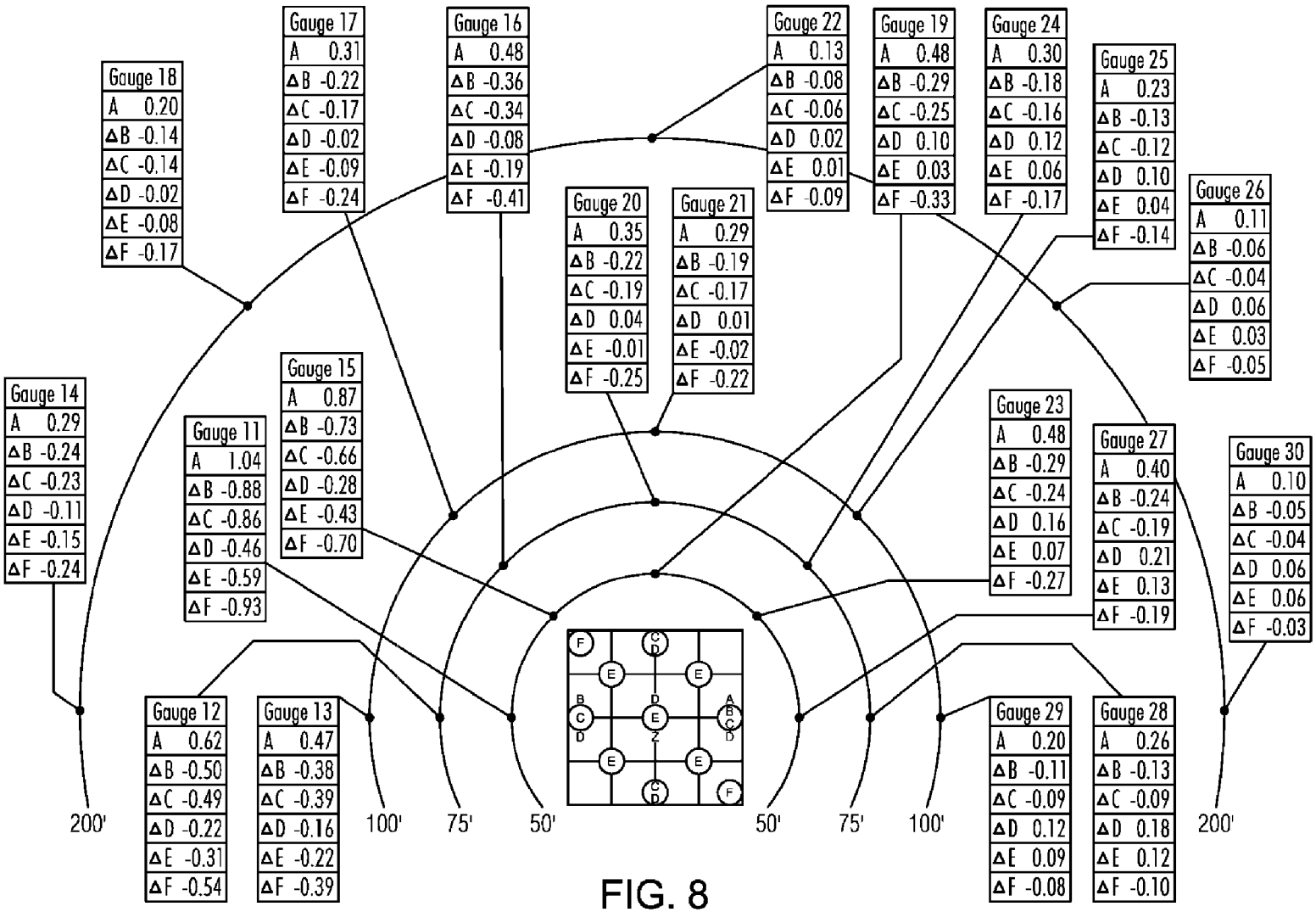
FIG. 8 presents a plot of change in peak pressure versus average single edge ignition.
Figure 9:
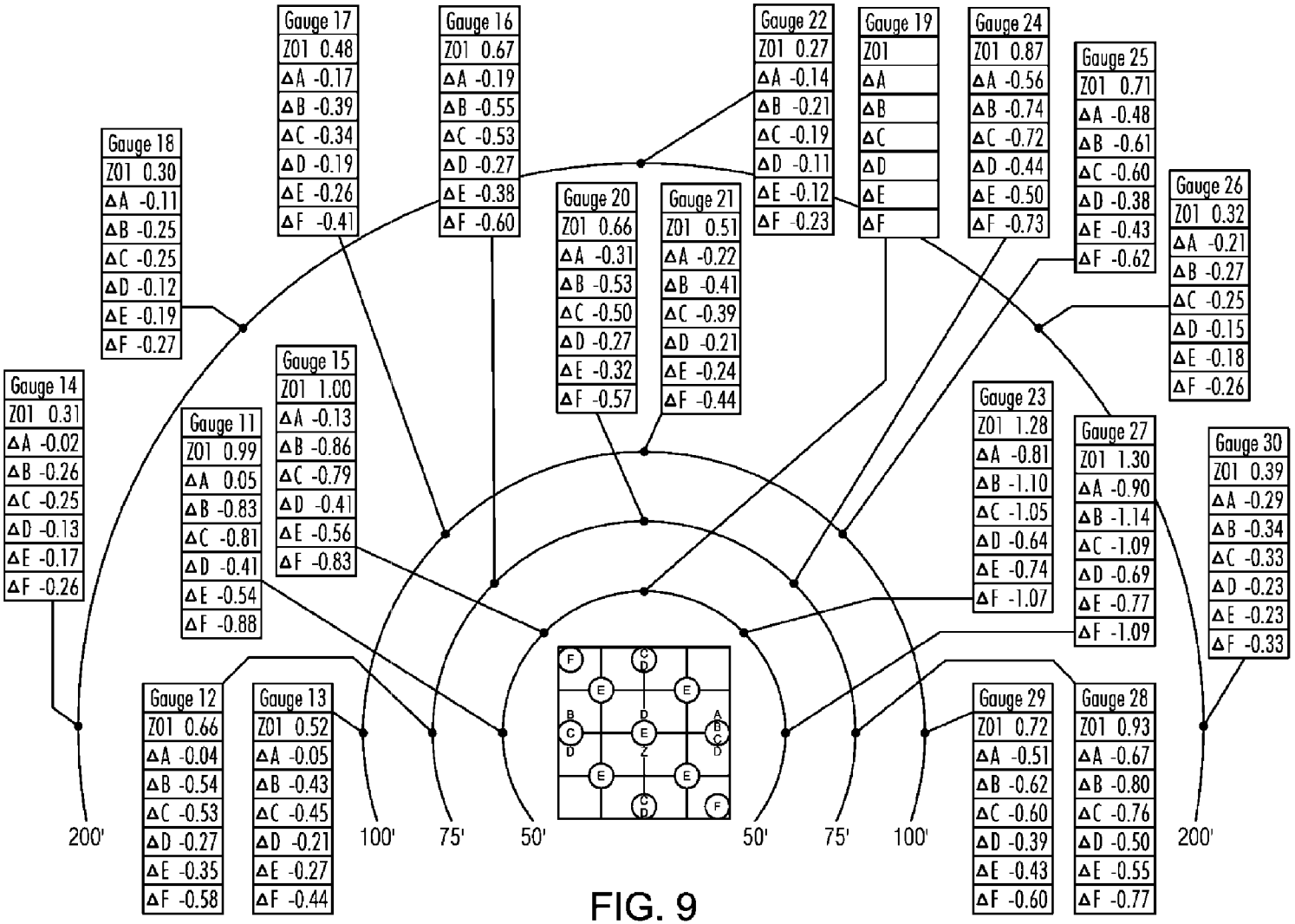
FIG. 9 presents a plot of change in peak pressure versus single central ignition.

The changes in peak pressure measured at each gauge location with respect to the average peak pressure measured at each gauge from Test Series A are given in FIG. 8. A similar comparison to the change in the peak pressures for each test with respect to Test Z01 is given in FIG. 9.

Particular Embodiments

Embodiment A. A system for reducing overpressure caused by an explosion of a vapor cloud comprising: one or more sensors operable to detect the explosion of the vapor cloud; and one or more igniters operable to ignite the vapor cloud at one or more locations after the explosion of the vapor cloud is detected, wherein each of the one or more igniters provides a discrete combustion zone, and each combustion zone forms a discrete pressure wave, thereby reducing overpressure caused by the explosion of the vapor cloud.

Embodiment B. The system according to Embodiment A, the system comprising a plurality of igniters operable to ignite the vapor cloud at multiple locations.

Embodiment C. The system according to Embodiment A or B, wherein at least one of the one or more sensors comprises an electromagnetic radiation sensor, a pressure sensor, an acoustic sensor, or any combination thereof.

Embodiment D. The system according to any one of Embodiments A to C, wherein at least one of the one or more sensors comprises an ultraviolet radiation sensor, an infrared radiation sensor, or a combination thereof.

Embodiment E. The system according to any one of Embodiments A to D, wherein at least one igniter is operable to ignite the vapor cloud within a time ranging from about 1 millisecond to about 1 second after the explosion of the vapor cloud is detected.

Embodiment F. The system according to any one of Embodiments A to E, wherein at least one igniter is operable to ignite the vapor cloud within a time ranging from about 1 millisecond to about 3 seconds after the explosion of the vapor cloud starts.

Embodiment G. The system according to any one of Embodiments A to F, wherein at least one igniter is operable to generate a spark having sufficient energy to ignite the vapor cloud.

Embodiment H. The system according to any one of Embodiments A to G, wherein at least one igniter is operable to generate a flame having sufficient energy to ignite the vapor cloud.

Embodiment I. The system according to any one of Embodiments A to H, wherein at least one igniter is a hot glowing wire or an exploding fuse wire.

Embodiment J. The system according to any one of Embodiments A to I, wherein a distance between any two adjacent igniters ranges from about 1 meter to about 25 meters, and wherein a distance between a first set of adjacent igniters is the same or different with respect to a distance between a second set of adjacent igniters.

Embodiment K. The system according to any one of Embodiments A to J, wherein the explosion occurs in a facility that includes at least one location at which one or more combustible vapors is processed or stored.

Embodiment L. The system according to any one of Embodiments A to K, wherein the facility is selected from the group consisting of: a hydrocarbon production facility, a hydrocarbon processing facility, a hydrocarbon refining facility, and a hydrocarbon storage facility.

Embodiment M. A method for reducing an overpressure caused by a vapor cloud explosion in a facility, comprising:

detecting the vapor cloud explosion; and then igniting the vapor cloud at multiple locations throughout to provide a discrete combustion zone at each location, wherein each combustion zone forms a discrete pressure wave, thereby reducing the overpressure caused by the vapor cloud explosion.

Embodiment N. The method according to Embodiment M, wherein at least one of the multiple locations is ignited within a time ranging from about 1 millisecond to about 1 second after the vapor cloud explosion is detected.

Embodiment O. The method according to Embodiment M or N, wherein at least one of the multiple locations is ignited within a time ranging from about 1 millisecond to about 3 seconds after the vapor cloud explosion starts.

Embodiment P. The method according to any one of Embodiments M to O, wherein at least one of the multiple locations is ignited with a spark.

Embodiment Q. The method according to any one of Embodiments M to P, wherein at least one of the multiple locations is ignited with a flame.

Embodiment R. The method according to any one of Embodiments M to Q, wherein a distance between any two adjacent locations ranges from about 1 meter to about 25 meters, and wherein a distance between a first set of adjacent locations is the same or different with respect to a distance between a second set of adjacent locations.

Embodiment S. The method according to any one of Embodiments M to R, wherein the facility includes at least one location at which one or more combustible vapors is processed or stored.

Embodiment T. The method according to any one of Embodiments M to S, wherein the facility is selected from the group consisting of: a hydrocarbon production facility, a hydrocarbon processing facility, a hydrocarbon refining facility, and a hydrocarbon storage facility.

Embodiment U. The method according to any one of Embodiments M to T, wherein the vapor cloud explosion is detected by a flame caused by the vapor cloud explosion, a pressure wave caused by the vapor cloud explosion, an acoustic emission caused by the vapor cloud explosion, heat caused by the vapor cloud explosion, or any combination thereof.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A system for reducing overpressure caused by an explosion of a vapor cloud, comprising:

a plurality of sensors operable to detect the explosion of the vapor cloud, wherein the plurality of sensors are capable of detecting one or more of a presence of a flame, an increase in pressure, a presence of an acoustic sound or a thermal emission, each of which are caused by the explosion of the vapor cloud;

a plurality of igniters operable to ignite the vapor cloud at multiple locations after the explosion of the vapor cloud is detected, wherein each of the one or more igniters provides a discrete combustion zone, and each combustion zone forms a discrete pressure wave, thereby reducing overpressure caused by the explosion of the vapor cloud; and at least one controller operably connecting the plurality of sensors to the plurality of ignitors to control the operation of the plurality of igniters in response to the detection of one or more of the presence of a flame, an increase in pressure, the presence of an acoustic sound or a thermal emission by at least one of the plurality of sensors.

2. The system of claim 1, wherein at least one of the plurality of sensors comprises an electromagnetic radiation sensor, a pressure sensor, an acoustic sensor, or any combination thereof.

3. The system of claim 1, wherein at least one of the plurality of sensors comprises an ultraviolet radiation sensor, an infrared radiation sensor, or any combination thereof.

4. The system of claim 1, wherein at least one igniter is operable to ignite the vapor cloud within a time ranging from about 1 millisecond to about 1 second after the explosion of the vapor cloud is detected.

5. The system of claim 1, wherein at least one igniter is operable to ignite the vapor cloud within a time ranging from about 1 millisecond to about 3 seconds after the explosion of the vapor cloud starts.

6. The system of claim 1, wherein at least one igniter is operable to generate a spark having sufficient energy to ignite the vapor cloud.

7. The system of claim 1, wherein at least one igniter is operable to generate a flame having sufficient energy to ignite the vapor cloud.

8. The system of claim 1, wherein at least one igniter is a hot glowing wire or an exploding fuse wire.

9. The system of claim 1, wherein a distance between any two adjacent igniters ranges from about 1 meters to about 25 meters, and wherein a distance between a first set of adjacent igniters is the same or different with respect to a distance between a second set of adjacent igniters.

10. The system of claim 1, wherein the explosion occurs in a facility that includes at least one location at which one or more combustible vapors is processed or stored.

11. The system according to claim 1, wherein the plurality of sensors includes two or more different sensors, wherein at least a first sensor detects one of a presence of a flame, an increase in pressure, a presence of an acoustic sound or a thermal emission, wherein at least a second sensor detects one of a presence of a flame, an increase in pressure, a presence of an acoustic sound or a thermal emission that is not detected by the at least a first sensor.

12. The system according to claim 1, wherein at least one controller controls the operation of the plurality of igniters in response to the detection of more of the presence of a flame, an increase in pressure, the presence of an acoustic sound or a thermal emission by at least two of the plurality of sensors.

13. A method for reducing an overpressure caused by an explosion of a vapor cloud in a facility, comprising:

detecting the explosion of the vapor cloud, wherein detecting the explosion of the vapor cloud includes sensing at least one of a flame caused by the explosion of the vapor cloud, a pressure wave caused by the explosion of the vapor cloud, an acoustic emission caused by the explosion of the vapor cloud, heat caused by the explosion of the vapor cloud, or any combination thereof; and then igniting the vapor cloud in at least one location to provide a discrete combustion zone at each location, wherein each combustion zone forms a discrete pressure wave, thereby reducing the overpressure caused by the explosion of the vapor cloud.

14. The method of claim 13, wherein the vapor cloud is located at multiple locations and at least one of the multiple locations is ignited within a time ranging from about 1 millisecond to about 3 seconds after the explosion of the vapor cloud starts.

15. The method of claim 14, wherein a distance between any two adjacent locations ranges from about 1 meters to about 25 meters meters, and wherein a distance between a first set of adjacent locations is the same or different with respect to a distance between a second set of adjacent locations.

16. The method of claim 13, wherein the facility includes at least one location at which one or more combustible vapors is processed or stored.

17. The method of claim 13, wherein detecting the explosion of the vapor cloud includes sensing at least one of a flame caused by the explosion of the vapor cloud, a pressure wave caused by the explosion of the vapor cloud, an acoustic emission caused by the explosion of the vapor cloud, heat caused by the explosion of the vapor cloud, or any combination thereof by two or more different sensors.

* * * * *